US008578574B1

(12) United States Patent
Smith

(10) Patent No.: US 8,578,574 B1
(45) Date of Patent: Nov. 12, 2013

(54) CASKET ENCLOSURE FOR MAUSOLEUM CRYPT

(75) Inventor: William S. Smith, Victor, NY (US)

(73) Assignee: Heritage Packaging, Victor, NY (US)

( * ) Notice: Subject to any disclaimer, the term of this patent is extended or adjusted under 35 U.S.C. 154(b) by 0 days.

(21) Appl. No.: 13/556,815

(22) Filed: Jul. 24, 2012

(51) Int. Cl.
*A61G 17/00* (2006.01)

(52) U.S. Cl.
USPC ..... 27/35; 52/134; 383/61.3

(58) Field of Classification Search
USPC ..... 27/11, 19, 27, 28, 35; 52/128, 129, 134, 52/139, 140; 383/61.3, 103, 108, 61.2, 59, 383/63, 64
See application file for complete search history.

(56) References Cited

U.S. PATENT DOCUMENTS

| | | | | |
|---|---|---|---|---|
| 3,468,577 | A | 9/1969 | Winston et al. | |
| 3,820,205 | A | 6/1974 | Shaw | |
| 3,945,094 | A * | 3/1976 | Daran et al. | 27/11 |
| 4,727,632 | A | 3/1988 | Yearsley | |
| 4,922,590 | A | 5/1990 | Yearsley | |
| 5,115,607 | A | 5/1992 | Pirozzoli et al. | |
| 5,341,548 | A * | 8/1994 | Zerick | 27/28 |
| 5,659,933 | A * | 8/1997 | McWilliams | 27/28 |
| 6,253,503 | B1 | 7/2001 | Flood | |
| 6,918,163 | B2 | 7/2005 | Pace et al. | |
| 8,096,028 | B2 * | 1/2012 | Bates | 27/35 |
| 2010/0263178 | A1 * | 10/2010 | Jensen et al. | 27/28 |

FOREIGN PATENT DOCUMENTS

| | | | |
|---|---|---|---|
| CN | 202069815 | U | 12/2011 |
| JP | 2004201805 | A | 7/2004 |
| KR | 100652495 | B1 | 11/2006 |
| WO | WO2010/015853 | A1 | 2/2010 |

OTHER PUBLICATIONS

VKM International, Inc., MausoTray Product Sheet, accessed via http://vkminternational.com/, Dec. 21, 2012.
VKM International, Inc., MausoGuard Product Sheet, accessed via http://vkminternational.com/, Dec. 21, 2012.
Norwalk-Wilbert Vault Company, Kryprotek Home Page, accessed via http://kryprotek.com/, Jan. 14, 2012.
Norwalk-Wilbert Vault Company, Kryprotek About Page, accessed via http://kryprotek.com/about/, Jan. 14, 2012.
Norwalk-Wilbert Vault Company, Kryprotek Value Page, accessed via http://kryprotek.com/value/, Jan. 14, 2012.
Norwalk-Wilbert Vault Company, Kryprotek Assembly Page, accessed via http://kryprotek.com/assembly/, Jan. 14, 2012.
Norwalk-Wilbert Vault Company, Kryprotek FAQS Page, accessed via http://kryprotek.com/faqs/, Jan. 14, 2012.
Norwalk-Wilbert Vault Company, Kryprotek Testimonials Page, accessed via http://kryprotek.com/testimonials/, Jan. 14, 2012.

* cited by examiner

*Primary Examiner* — William Miller
(74) *Attorney, Agent, or Firm* — Woods Oviatt Gilman LLP; Katherine H. McGuire, Esq.

(57) ABSTRACT

A hermetically sealed casket enclosure comprising a tray; a bottom cover adapted to be housed within the tray and having an open perimeter equipped with a first half of a zipper; a top cover adapted to fit over a casket and proportioned to mate with the bottom cover wherein the top cover has an open perimeter equipped with a second half of a zipper which corresponds with and engages the first half of the zipper so as to join the top cover to the bottom cover; and a clasp for sealing a start end and a finish end of the zipper.

14 Claims, 5 Drawing Sheets

CASKET ENCLOSURE FOR MAUSOLEUM CRYPT

FIELD OF THE INVENTION

The present invention relates to a system and method for providing a hermetically sealed enclosure that completely envelopes a casket, and more particularly, the present invention relates to a system and method for providing a hermetically sealed enclosure that completely envelopes a casket where the casket will be interred in an above ground mausoleum crypt.

BACKGROUND OF THE INVENTION

Enclosing a casket within a burial vault is well known in the mortuary sciences. Enclosures for use with caskets to be interred within above ground mausoleum crypts are often constructed as two-piece assemblies having a bottom, on which sits the casket, and a top (also typically referred to as a cover or dome) which is placed around the casket. The top and bottom are then sealed (e.g., by heat sealing or use of an adhesive glue or tape) to form a hermetically sealed enclosure. Casket enclosures known in the art are generally either heavy synthetic plastic materials which are bulky and expensive or light weight plastic films or bags which, while being more cost efficient, are more easily punctured or damaged thereby destroying the hermetic seal.

Beyond weight and expense, current casket enclosures further suffer from a number of significant drawbacks. Chief among these drawbacks is the inability to form a truly hermetic seal between the top and bottom members. A number of systems have been designed wherein the top and bottom members are formed of plastic having a moderately high melting point where the seal is generated by applying a heat source to the overlapped members to fuse the members together. However, applying too much heat can damage one or both members leading to a hole within the enclosure, while applying too little heat can incompletely form a seal leading to a gap within the enclosure.

Alternative attempts to form a hermetic seal include means which employ an adhesive. Adhesives can either be glued-based or tape-based. The glue-based adhesives attempt to seal the top layer to the bottom layer by spreading a line of glue along one or both edges of the top or bottom and pressing the edges together until the glue cures. Unfortunately, the glue-based adhesives suffer significant drawbacks. First, the glues are often toxic or noxious chemicals which require special handling or personal protective gear. Second, this process is time consuming as users must first produce a safe working environment and then physically glue and hold each seam until the glue cures. And third, the seal may be incomplete for failure to apply a sufficient amount of adhesive, failure to supply a sufficient amount of pressure or failing to wait until the glue cures thereby disrupting the seal.

Turning now to tape-based adhesives, the top and bottom layers are overlapped with the tape being placed over the outer edge to form a seal. Tape-based adhesives suffer similar drawbacks as glue-based adhesives (incorrect application of pressure, improper application of the tape) while also suffering from eventual degradation of the adhesive material. Indeed, over time the adhesive will dry and crack leading to gaps within the seal. Furthermore, either type of adhesive prevents opening and resealing of the enclosure should the need arise to open the casket.

In the prior art, U.S. Pat. No. 4,922,590 describes a casket enclosure having a flexibly rigid bottom tray within which rests a casket. A Tyvek cover is then placed over the casket and sealed to the bottom tray using an adhesive tape to cover the seam. The Tyvek cover is also equipped with a one-way check valve to relieve gas pressure generated from decomposition from within the enclosure. The '590 patent further provides that the bottom tray is foldable such that the tray forms a sturdy self-sustaining shipping and storage container when closed. The Tyvek cover and adhesive are housed within the tray when the unit is being stored or shipped. While this folding bottom tray may provide the benefit of producing its own shipping container, this feature also presents a flaw to this device. As the bottom tray is used to form a hermetic seal when joined with the cover, any damage, holes or cracks (particularly at the creases) would destroy the seal. Additionally, as these holes or cracks are on the bottom tray, and any fluids released during decomposition which escapes the casket will also leak out of the enclosure. This only adds to the potential release of odors or attraction of pests. The adhesive tape described by the '590 patent also suffers those drawbacks as discussed previously.

As such, there is a need for a system and method for enclosing a casket that is light weight, compact, cost efficient and provides a long-lived hermetic seal. Additionally, there is a need for a system and method that provides a hermetically sealed enclosure which further enables containment of any leaks should the casket seal be disrupted. The present invention addresses these and other needs.

BRIEF SUMMARY OF THE INVENTION

In general, one embodiment the present invention is directed to a casket enclosure for mausoleum crypts which overcomes the problems and deficiencies in the prior art. The casket enclosure of the present invention is generally comprised of a two piece sealing system for enclosing a casket with said system being placed within a foldable tray. The two piece construction, having a top half and bottom half, provides a barrier which will contain any liquids, gasses or odors yielded during decomposition of the casket and its contents. For additional protection, a superabsorbent pad may be placed within the bottom half prior to loading of the casket within the tray so as to absorb any fluids which may be released from the sealed casket. The top piece of the two piece construction is also equipped with a one-way pressure relief valve to relieve any pressure generated from the decomposition process. The two halves of the sealing system are joined using an airtight polyethylene zipper track. A clasp and housing assembly envelops and seals the zipper ends. The foldable tray is adapted to contain the sealing system and all required hardware when the tray is folded closed during shipping or storing of the unused enclosure.

The casket enclosure system of the present invention is a light-weight, relatively inexpensive product which provides a hermetically sealed enclosure that completely envelops a casket to be placed into a mausoleum crypt. The casket enclosure system of the present invention allows mortuary workers to seal a casket within a short period of time (generally less than one-half hour) without exposing those workers to dangerous conditions or chemicals. The zipper enclosure also allows for the opening and resealing of the enclosure and casket should the need arise.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
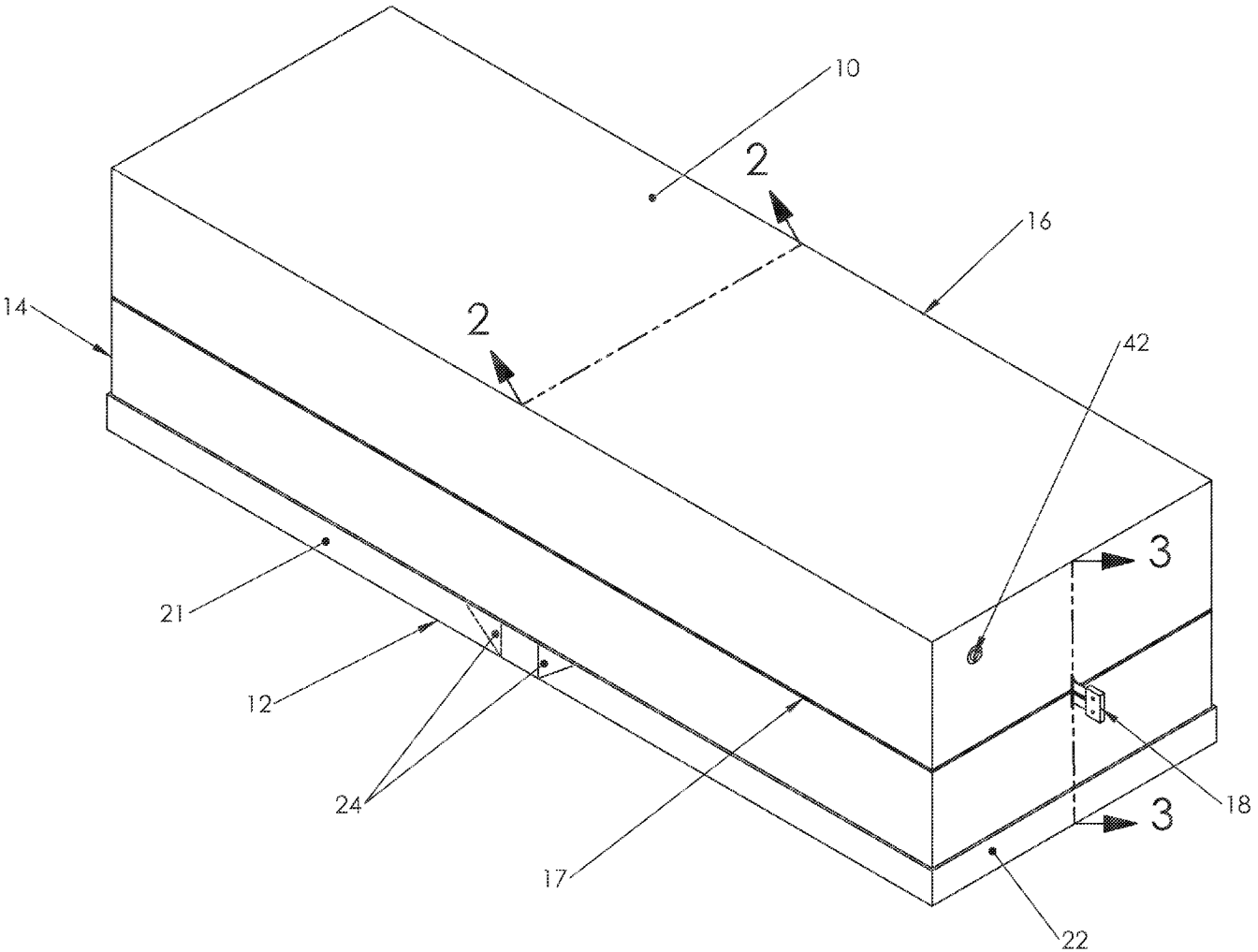
FIG. 1 is a perspective view of the casket enclosure system of one embodiment of the present invention.
Figure 2:
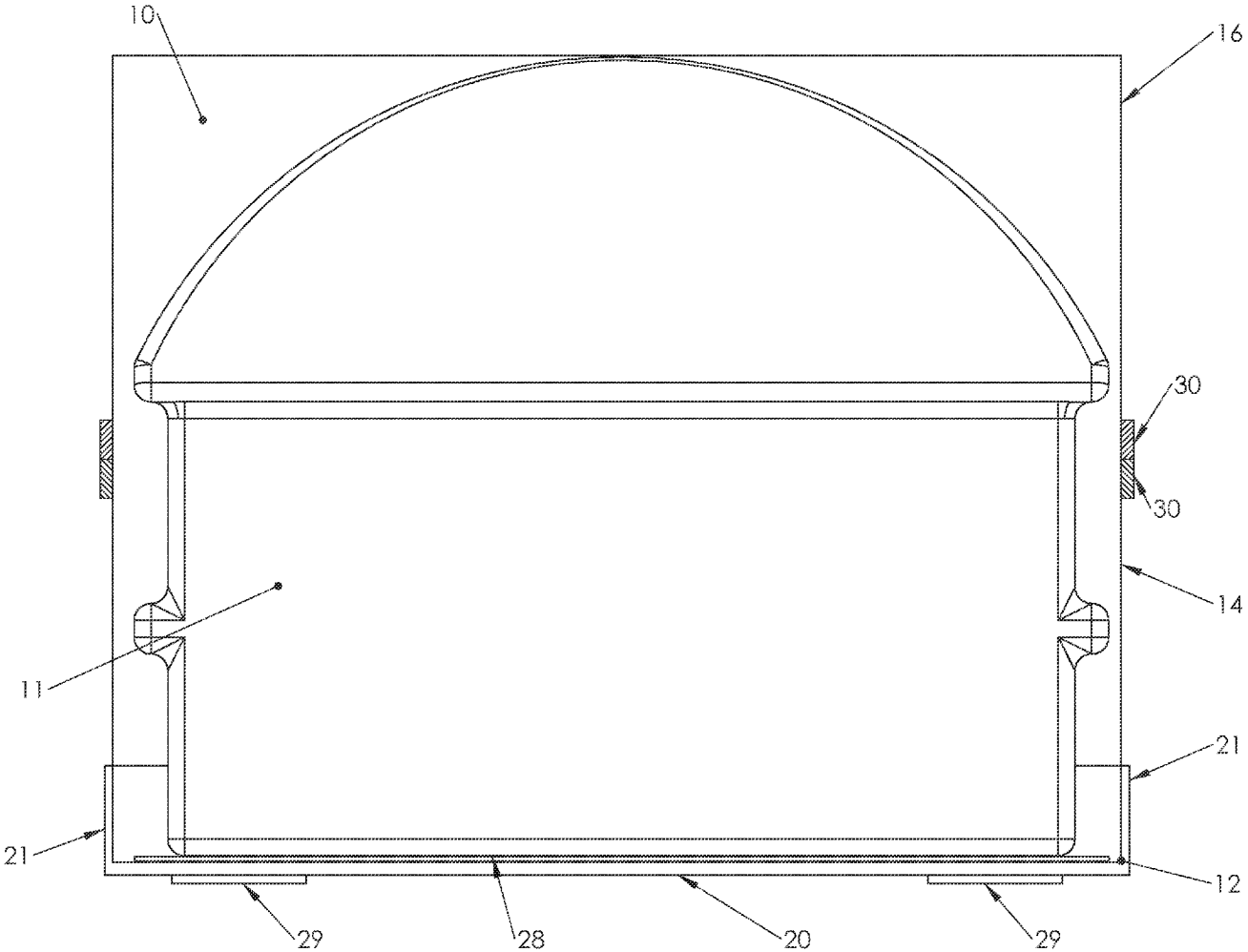
FIG. 2 is a vertical cross-section of the casket enclosure system taken generally along line 2-2 of FIG. 1.

Referring to the drawings in detail, and specifically to FIGS. 1 and 2, one embodiment of a casket enclosure 10 of the present invention is generally comprised of a tray 12, a bottom cover 14 and a top cover 16. Preferably, tray 12 is a fabricated, corrugated plastic member having a base 20, a pair of side walls 21 and a pair of end walls 22. To assist mortuary employees in sliding the casket enclosure within a mausoleum crypt, base 20 is preferably further provided with one or more slides 29. Slides 29 may extend generally the entire longitudinal length of base 20. Traditionally, small plastic beads are used to assist sliding of the casket within the crypt opening. However, these plastic beads may land on the mausoleum floor thereby created a slipping hazard for employees. Thus, slides 29 are constructed with integral features to reduce the coefficient of friction between the tray and the bottom surface of the crypt enabling easier installation while also preventing a dangerous work environment. For example, in one embodiment, slides 29 may include a pattern of dimples on their outer surface which reduces surface area contact and thus friction between the tray and mausoleum floor. Slides 29 also elevate tray base 20 slightly above the surface of the crypt thereby aiding in preventing damage to the enclosure and potential loss of the hermetic seal.

In a further embodiment, tray 12 is designed to further function as a foldable carrier by incorporating a pair of fold lines 24 such that the tray is folded in roughly two equal portions wherein one end wall fits snuggly within the second end wall. Fold lines 24 are further reinforced with sealing tape and ultrasonic welding to resist and prevent splitting or tearing of the tray. The foldable tray then further functions as a storage and/or shipping container for the remaining items which make up the enclosure. If tray 12 is equipped with fold lines 24, slides 29 extend longitudinally generally from each end of base 20 to the closest fold line 24 so as not to impede folding of the tray.

Both bottom cover 14 and top cover 16 are constructed of heavy-duty flexible barrier packaging material. The covers are liquid and airtight, and further possess superior puncture and tear resistance as well as superior heat-seal strength. The bottom cover 14 and top cover 16 are joined to one another through an airtight polyethylene zipper track 17. One half of the zipper track is hermetically sealed to its respective cover's open perimeter. During assembly, a zipper pull tab (not shown) initiates meshing of the bottom cover zipper half 30 with the top cover zipper half 40. The zipper halves may comprise a continuous flange and groove, respectively, which may be hermetically engaged with one another using the zipper tab pull. The zipper pull tab is pulled completely around the casket so as to end proximate the start location. In a preferred embodiment, the zipper pull tab is distinct from the zipper track and is removed from the track once zippering is completed. The zipper pull tab is then housed with the casket enclosure should there be a need in the future to use the zipper pull tab to unzip the two halves. The start and end portions of the joined zipper track are then hermetically sealed using an end cap 18, as will be discussed in more detail below with regard to FIGS. 3-5.

In a preferred embodiment, bottom cover 14 is factory-adhered to tray 12 so that the bottom cover automatically deploys (unfolds) with the unfolding of the tray. In a further embodiment, the casket enclosure is also supplied with a superabsorbent pad 28 which is placed within bottom cover 14 before the cover is loaded with casket 11. The superabsorbent pad 28 provides additional protection should any fluids be released from the sealed casket during internment. Additionally, top cover 16 is further optionally equipped, via heat-sealing, with a one-way pressure relief valve 42 for relieving any pressure generated within the enclosure from the decomposition process.

Figure 3:
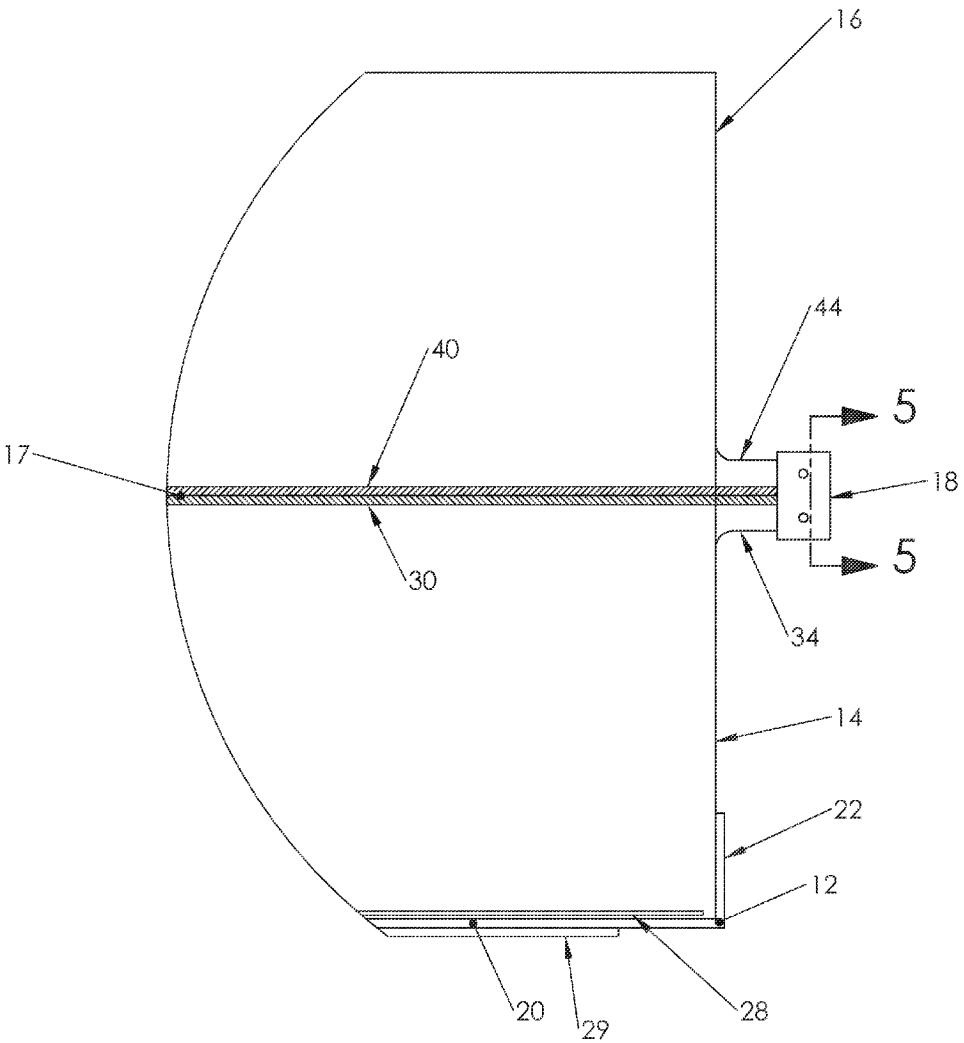
FIG. 3 is a vertical cross-section of the zipper and housing assembly of the casket enclosure system taken generally along line 3-3 of FIG. 1.

Referring now to FIG. 3, a vertical cross-section of the casket enclosure highlighting the zipper ends and sealing cap is shown. In a preferred embodiment, bottom cover 14 is constructed to include a bottom extending tab 34 in seamless communication with the main body of bottom cover 14 but projects outwardly from the enclosure. Similarly, top cover 16 is constructed to include a top extending tab 44. The extending tabs 34 and 44 are constructed such that the ends of the zipper halves 30 and 40 rest in a plane generally perpendicular to the end of the casket and are sufficiently distal from the end of the casket so as to provide enough clearance to hermetically seal the zipper ends using an end cap 18.

Figure 4:
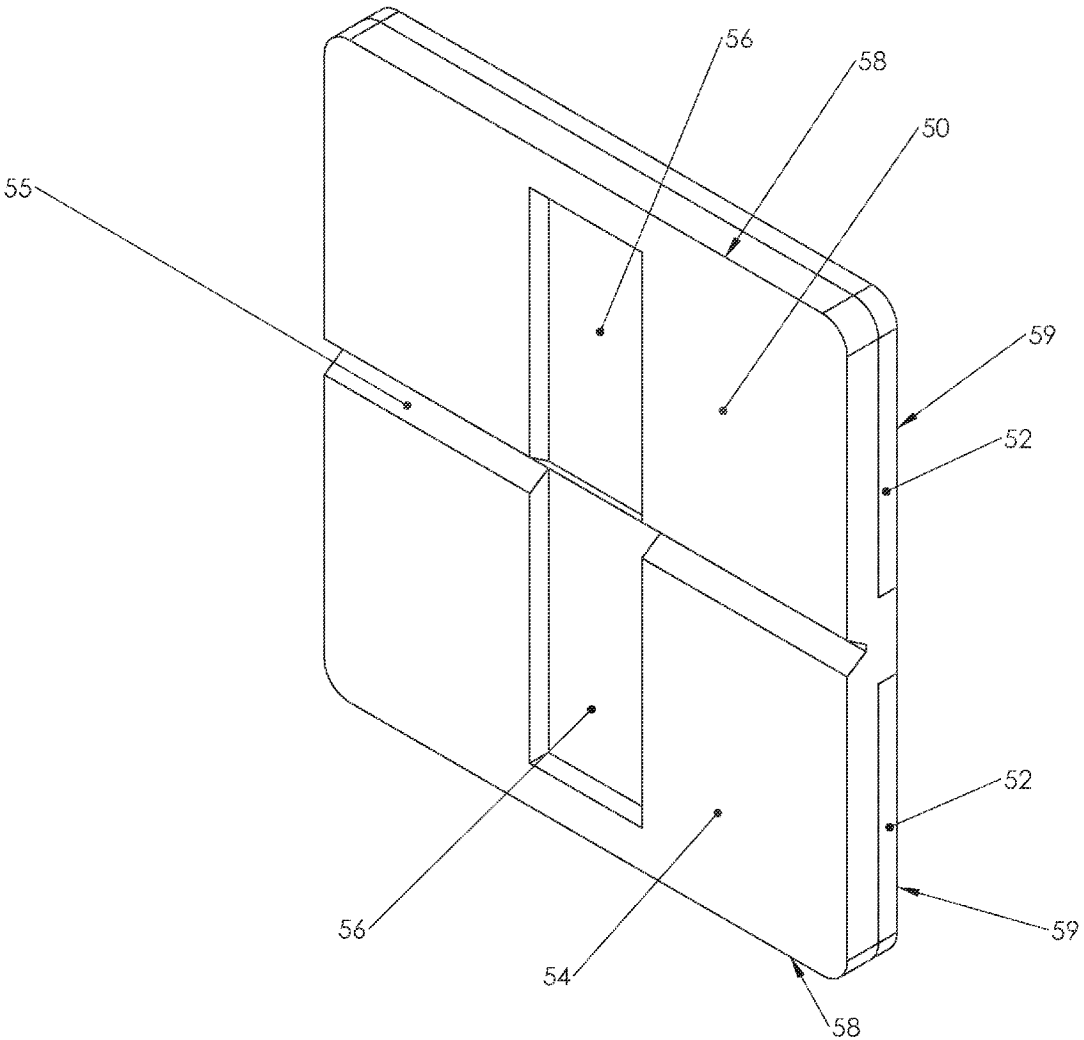
FIG. 4 is a perspective view of a zipper end clasp used in conjunction with the housing to seal the zipper ends of one embodiment of the casket enclosure system of the present invention.

As shown in FIG. 4, end cap 18 is generally comprised of an end clasp 50. In one embodiment, end clasp 50 is constructed of a resilient rubber and has a chamfered channel 55 situated at the midpoint of one face. The chamfered channel 55 permits flexing of the end clasp (in the manner of a living hinge) so as to allow the inner face 58 on each side of the channel to contact one another. The resilient rubber is flexible enough to permit such flexing, but not rigid enough to split or crack as a result. End clasp 50 is further fabricated with recesses 56 which are proportioned to fit snuggly around the ends of zipper track 17. End clasp 50 may be secured to extended tabs 34 and 44 using any suitable securing means, including but not limited to an adhesive, a clamp such as a spring clamp or c-clamp, or a physical fastener such as a bracket, snaps, clips, or screws. Indeed, while any suitable fastener may be employed, in a preferred embodiment, end cap 18 further comprises a housing 60 for securing and sealing end clasp 50 about the ends of zipper track 17.

Figure 5:
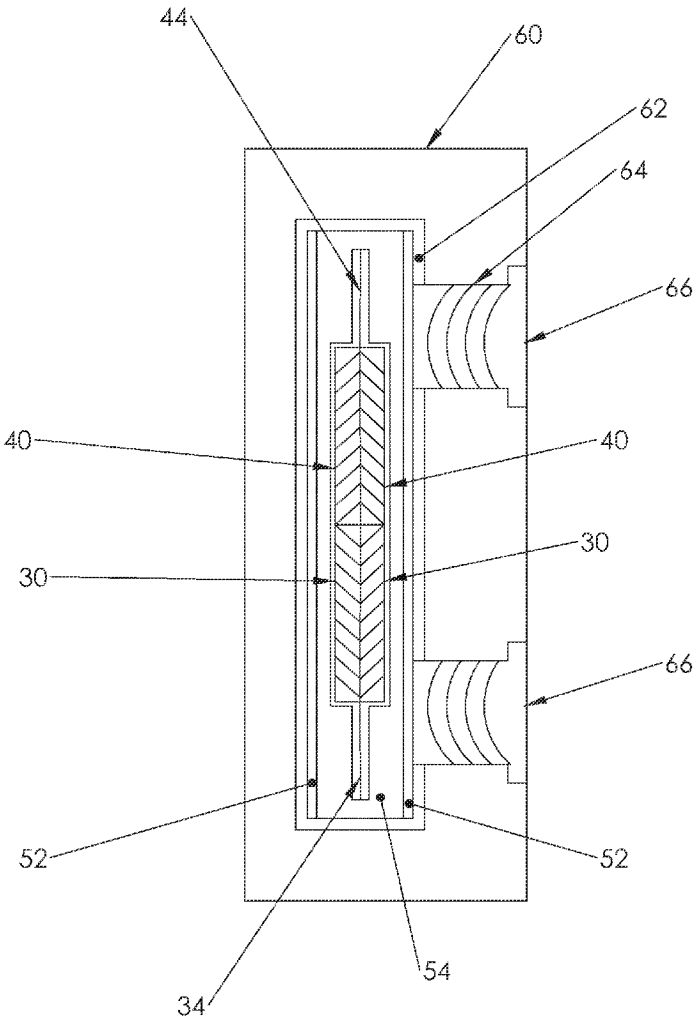
FIG. 5 is a vertical cross-section of the zipper, clasp and housing assembly of the casket enclosure system taken generally along line 5-5 of FIG. 4.

As shown in FIG. 5, housing 60 is proportioned to snuggly encapsulate end clasp 50 within cavity 62 once clasp 50 is positioned and folded about zippered extended tabs 34 and 44. Housing 60 is preferably a machined or cast metal block having a pair of threaded bore holes 64 extending from one face into cavity 62. Counterpart cap screws 66 are then threaded (e.g., with an Allen wrench supplied with the assembly) into threaded bore holes 64 with the cap screws 66 applying sealing pressure to an outer face 59 of end clasp 50 (see FIG. 4). As described above with reference to FIGS. 1 and 2, bottom cover zipper half 30 extends along the entire open perimeter of bottom cover 14 such that the start and finish of the zipper track are located proximate one another. The start and finish of bottom cover zipper half 30 are depicted via reference numerals 30(R) and 30(L), noting one end is on the right when facing the end of the casket while the other is on the left. Similarly, the start and finish of top cover zipper half 40 are likewise situated on top cover 16 and have ends 40(R) and 40 (L) terminating proximate one another on extended tab 44. As describes above with reference to FIG. 4, the extending flaps, with their associated zipped ends, are positioned between the folded inner faces 58 of end clasp 50. Cap screws 66 are threaded so as to apply pressure to an outer face 59 of end clasp 50 thereby compressing and hermetically sealing end clasp 50 (and extensions 34 and 44 with the zipped zipper track) against the distal wall of housing 60. Use of housing 60 and cap screws 66 allows for quick and efficient sealing of the ends while also permitting unsealing and resealing of the casket enclosure should the need arise. Notably, in a further preferred embodiment, with reference again to FIG. 4, end clasp 50 is manufactured to further comprise two metal plates 52 insert molded within the resilient rubber such that the metal plates form outer face 59. The interior ends of cap screws 66 then impact the metal plates rather than the resilient rubber. The metal plates prevent damage to the rubber due to the cap screws while also promoting even clamping pressure across the entire face of end clasp 50 enabling better clamping of the zippered ends.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A hermetically sealed casket enclosure comprising:

a. a tray;

b. a bottom cover housed within said tray and having an open upper perimeter equipped with a first half of a zipper, said bottom cover adapted to receive a casket therewithin;

c. a top cover adapted to fit over said casket and proportioned to mate with said bottom cover wherein said top cover has an open lower perimeter equipped with a second half of said zipper which corresponds with and engages said first half of said zipper so as to releasably join said top cover to said bottom cover; and d. a clasp sealing a start end and a finish end of said zipper.

2. The hermetically sealed casket enclosure of claim 1 wherein said bottom cover and said top cover each further comprise an extended tab wherein said start end and said finish end are situated on said extended tab.

3. The hermetically sealed casket enclosure of claim 1 wherein said top cover is equipped with a pressure relief valve.

4. The hermetically sealed casket enclosure of claim 1 wherein said tray is foldable between a closed shipping and storage position and an open casket receiving position.

5. The hermetically sealed casket enclosure of claim 1 further comprising a housing securing said clasp with said housing.

6. The hermetically sealed casket enclosure of claim 5 wherein said clasp is secured in said housing by at least two screws.

7. The hermetically sealed casket enclosure of claim 1 further comprising an absorbent pad placed under said casket within said bottom cover.

8. The hermetically sealed casket enclosure of claim 1 wherein said first half of said zipper is heat sealed to said bottom cover and said second half of said zipper is heat sealed to said top cover.

9. The hermetically sealed casket enclosure of claim 1 wherein said tray has a pair of side walls and a pair of end walls extending upwardly from a base and wherein said side walls and said end walls are sonically welded to said base.

10. The hermetically sealed casket enclosure of claim 1 wherein said tray has a base having a top face proximate said bottom cover and a bottom face and said tray further comprises at least two slides mounted on said bottom face.

11. The hermetically sealed casket enclosure of claim 1 wherein said bottom cover is factory-adhered to said tray.

12. A method of providing a hermetically sealed casket enclosure comprising the steps of:

a. providing a tray;

b. positioning a bottom cover having an open upper perimeter equipped with a first half of a zipper within said tray;

c. placing a casket within said bottom cover;

d. covering said casket with a top cover fitted over said casket and proportioned to mate with said bottom cover wherein said top cover has an open lower perimeter equipped with a second half of said zipper which corresponds with and engages said first half of said zipper so as to join said top cover to said bottom cover; and e. hermetically sealing said casket enclosure by clasping a start end and a finish end of said zipper with a clasp.

13. The method of claim 12 further comprising the step of securing a housing over said clasp.

14. The method of claim 12 wherein said bottom cover is factory-adhered to said tray.

* * * * *